United States Patent [19]

Pike et al.

[11] 4,023,060

[45] May 10, 1977

[54] RUGGEDIZED, HIGH POWER TUNGSTEN-HALOGEN LAMP

[75] Inventors: Bernard Pike, Ipswich; Thomas A. Brewin, Hamilton; Charles Kokinos, Jr., Lynn, all of Mass.

[73] Assignee: GTE Sylvania Incorporated, Salem, Mass.

[22] Filed: Nov. 28, 1975

[21] Appl. No.: 636,326

[52] U.S. Cl. ..... 313/273; 313/276; 313/279

[51] Int. Cl.[2] ..... H01J 1/88

[58] Field of Search ..... 313/273, 274, 275, 276, 313/277, 278, 279

[56] References Cited

UNITED STATES PATENTS

| | | | |
|---|---|---|---|
| 3,626,236 | 12/1971 | Robinson et al. | 313/276 X |
| 3,909,653 | 9/1975 | Bottone et al. | 313/273 X |

*Primary Examiner*—James B. Mullins
*Attorney, Agent, or Firm*—Edward J. Coleman

[57] ABSTRACT

A high power tungsten-halogen lamp having a filament arrangement suspended between a pair of alumina bridge members which are supported by a pair of vertically disposed tungsten rods. To provide a ruggedized mount, the free ends of the vertical rods are retained in respective externally protruding cavities provided in the dome of the lamp envelope.

7 Claims, 1 Drawing Figure

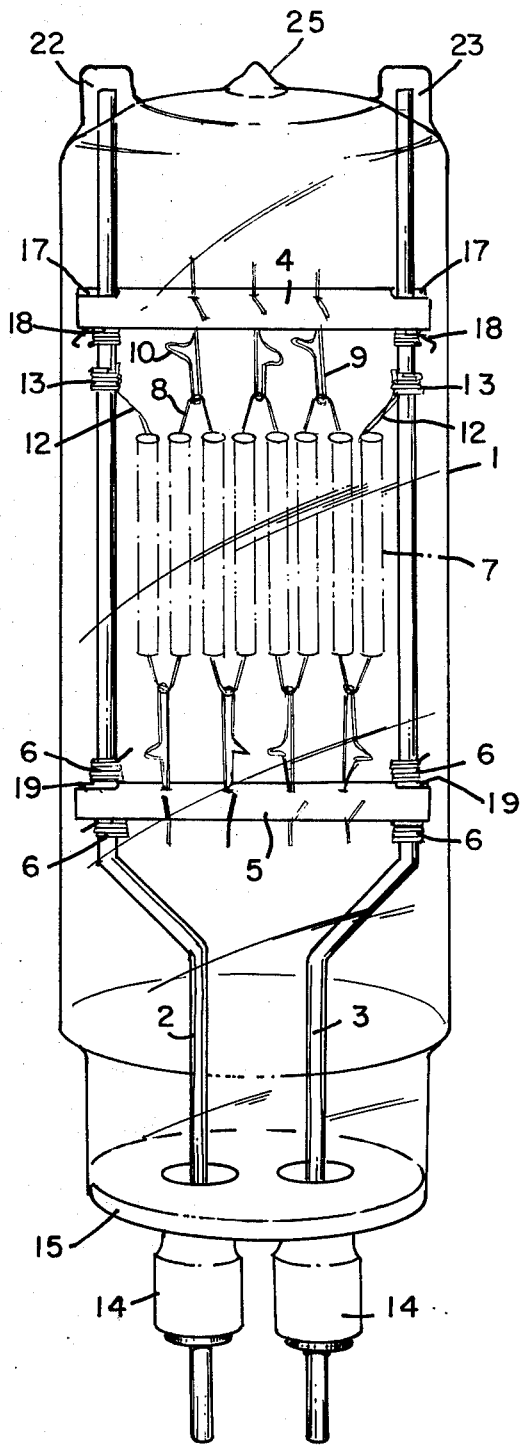
25
22
23
17
4
17
18
18
10
9
13
8
13
12
12
1
7
6
6
19
19
6
6
5
2
3
15
14
14

RUGGEDIZED, HIGH POWER TUNGSTEN-HALOGEN LAMP

BACKGROUND OF THE INVENTION

This invention relates to incandescent lamps in general and has particular reference to high power tungsten-halogen lamps and the filament mount structure thereof.

Tungsten-halogen lamps have become increasingly useful in lighting applications because of their higher efficiency, better maintenance and smaller size in comparison to prior art incandescent lamps. As a result of this commercial success, tungsten-halogen lamps are being developed with higher power ratings. These lamps are necessarily larger and present some problems that are not usually encountered with prior art incandescent lamps or lower wattage tungsten-halogen lamps. One problem concerns the adequacy of the support of the mount at the end opposite the lamp base, the seal of which is sometimes the only support for the mount. U.S. Pat. 3,497,752 shows a mount for such lamps. However, in that patent, the filament is supported only at the ends thereof, and thus can be supported directly by the tungsten lead-in wires.

A subsequent U.S. Pat. No. 3,543,962 concerns a folded filament which must be supported at other points thereof intermediate the filament legs and preferably at the filament folds. The fold support wires cannot be directly connected to the tungsten lead-in wires since connections would result in the shorting out of part of the filament.

Tungsten-halogen lamps having folded coiled filaments, as in the '962 patent, are sometimes preferable to those having coiled filaments, such as are disclosed in the '752 patent, where it is desired to reduce the effective area of incandescence of the filament as, for example, where the lamp is operated in conjunction with an external reflector and where efficient directional illumination is required, as in motion picture and television lighting.

In addition, the corrosive effect of halogen, especially at the high temperatures at which lamps of this type operate, severely limits the materials that can be used within a halogen lamp envelope. Generally, only tungsten and quartz are suitable. In lower wattage lamps, the filament can be welded or hot crimped to the lead-in wire. But, mainly because of the increased wire sizes required, such connections are not usually satisfactory in higher wattage lamps.

The above-mentioned U.S. Pat. No. 3,543,962 discloses a halogen lamp having a bridge which materially stabilizes the central positioning of a folded coiled filament mounted thereof. The bridge comprises quartz tubing supported by tungsten rods. Tungsten support wires, inserted through substantially diametral holes in the quartz tubing and supported thereby, insulatively support the filament at the folds thereof. The support wires have sufficient flexibility and adjustability to conveniently permit the takeup of any slack between the quartz tubing and the individual filament folds when the filament is mounted on the bridge. More specifically, one end of the support wire extends through a diametral hole in the quartz tubing and is bent therearound. The opposite end of the support wire extends through and engages a fold of the filament. Between its ends, the support wire has a substantially U-shaped loop, the loop having sufficient flexibility to permit the legs of the U to be squeezed together. Thus when the filament is mounted on the bridge, any slack in the filament can be taken up by squeezing the U-shaped loops of the support wires.

In some cases, it may be desirable to continue the end of the support wire that engages the filament fold back through the diametral hole in the quartz tubing. Thus, both ends of the support wire extend through the diametral hole and there is effectively a double wire supporting each filament fold. Such a construction can improve the resistance of the filament to sagging, especially when the lamp is operated in a horizontal position.

Preferably, the quartz tubing has slots at each end for the purpose of engaging the above-mentioned tungsten rods and to prevent rotation thereof, said rods also being the lead-in members for the lamp. Of course, the rods must have sufficient rigidity to permit take up of filament slack without deflection and to adequately support the filament mounted bridge. Preferably, also, electrical connection is established between the rod and the filament by a compressive connector coil of the type shown in U.S. Pat. No. 3,497,752. Said coil constrictively encircles the lead-in rod and an abutting portion of the filament leg. Protruding arms of these coils can provide some degree of mount stabilization, but for large high power lamps, the coil arms alone are not sufficient for this purpose and tend to break off.

Although the lamp described in U.S. Pat. No. 3,543,962 represented a significant improvement in the art, such a filament mount structure, when employed in large, high-power studio lamps, can exhibit fracture and breakage problems under shock and vibration. Previous approaches for countering this problem included projection of one of the supporting lead-in wires or rods (or a bridge-connected wire) into the exhaust tip to provide rigidity at the free end of the mount. This design was tried without success in large high power lamps, as, during shock and vibration testing, breakage occurred on the bridge member used to anchor the projecting wire. Other prior designs deal with the mount wobble problem by embedding the support rods at each end of the bulb in a press seal. Such a tungsten-to-quartz seal, however, can lead to cracks at the seal area due to thermal expansion differences, and the approach is somewhat unfeasible for large high-power lamps. Yet another prior method that has been employed to rigidize the mount of smaller low power lamps comprises the use of a wall bumper loop at the free ends of the tungsten support rod which bears against the dome-side area of the lamp envelope. For example, see U.S. Pat. No. 3,898,505. Upon examining this approach, however, we find such a construction to be relatively expensive and, in large high power lamps, the brittle tungsten loop is subject to breakage.

Still a further approach is shown in U.S. Pat. No. 3,626,236, wherein internally projecting quartz tubes are sealed to the interior of the envelope, and coils on the upper ends of the support rods fit into these tubes to secure the top of the mount. Although perhaps satisfactory in smaller, lower power lamps with a press seal base, such an upper support means is unsatisfactory for large high power lamp structures. The lever action of the rods or coils on the depending tubes can cause the tubes to break off, especially for the cup seal-supported rod structures typical for high power lamps. Further, the construction appears difficult and expensive to fabricate in production.

In addition to the above, quartz bridges have been found to be subject to breakage during mounting of the coil filament and under shock and vibration.

SUMMARY OF THE INVENTION

Accordingly, it is an object of the present invention to provide an improved filament mount structure for a tungsten-halogen lamp.

It is a particular object to provide an improved ruggedized construction for high power tungsten-halogen lamps.

These and other objects, advantages and features are attained, in accordance with the invention, by providing externally protruding cavities in the dome of the lamp envelope for respectively retaining the free ends of the filament support rods. The rods are not sealed in these envelope-retaining cavities; hence, cracking problems due to thermal expansion mismatches are avoided. The cavities positively retain the rods with a minimum of wobble, and there is no spring pressure against the envelope walls. Preferably the cavities are tubular quartz sections sealed to the exterior envelope dome so as to provide rugged means for retaining the rods in a positive fashion. During vibration, pressure or impact from the rods is absorbed to a large degree by the strong dome structure, rather than solely by the tubular extension.

According to another aspect of the invention, the bridge members, supported between the rods for holding the tungsten filament configuration, are formed of alumina, a material which provides advantages of strength, cost and ease of fabrication over quartz.

BRIEF DESCRIPTION OF THE DRAWING

The single FIGURE is a perspective view of a high wattage tungsten-halogen lamp in accordance with this invention.

DESCRIPTION OF THE PREFERRED EMBODIMENT

The drawing illustrates an example of a 10,000 watt studio lamp made in accordance with the present invention. Tubular envelope 1 is formed of quartz and is 3 inches in diameter by 7½ inches long. Wall thickness is about 2 mm. The envelope is light-transmitting and hermetically sealed. Lead-in members 2 and 3 are tungsten rods, 125 mils in diameter, and are supported in cylindrical quartz-to-molybdenum cup seals 14 at the base 15 of the lamp and extended into the interior of envelope 1, generally in parallel. Rods 2 and 3 are about ⅞ inch apart at the base end of the lamp and about 2⅜ inches apart at the filament mount portion thereof. Disposed between and supported at the upper portions of rods 2 and 3 is a section of alumina tubing 4. Tubing 4 is 2½ inches long by 5/16 inch outside diameter and has a wall thickness of 1/16 inch. Each end of tubing 4 has a vertical slot 17 therein, 5/32 inch wide by 3/16 inch long. Rods 2 and 3 pass vertically through slots 17 and extend to the dome of the lamp envelope. Tubing 4 is prevented from downward movement on rods 2 and 3 by compressive coils 18 encircling rods 2 and 3 and abutting the lower side of each end of tubing 4.

Alumina tubing 5 is substantially similar to tubing 4 and is supported between rods 2 and 3 at a point about 3½ inches below tubing 4. Tubing 5 is parallel to tubing 4 and also has vertical slots 19 at the ends thereof, the slots being th same size as those of tubing 4. Vertical portions of rods 2 and 3 fit into the slots 19, and tubing 5 is prevented from movement either upward or downward on rods 2 and 3 by compressive coils 6 encircling rods 2 and 3, and abutting each side of each end of tubing 5.

Planar filament 7 is centrally disposed between tubings 4 and 5, which are generally referred to as bridges or bridge members. Filament 7 is made of a single length of 45 mil tungsten wire and comprises eight coiled sections, each section being 1¼ inches long by 175 mils diameter. The eight coiled sections are substantially parallel to each other and define a rectangular area of about 2 inches by 1¼ inches. Connecting adjacent coiled sections to each other are single wire loops 8, extending about ½ inch beyond the ends of the coiled sections. There are three such loops at the upper part of filament 7 and four at the lower part.

Each loop 8 is supported, and maintained slightly in tension, by a support wire 9, extending from the adjacent alumina tubing bridge to the loop. Each support wire 9 is made of a single length of 30 mil tungsten wire. Each support wire 9 extends through a rectangular hole in the quartz tubing substantially in alignment with its respective loop 8, is folded around said loop, doubled back through said hole and is bent securely around the quartz tubing. One side of support wire 9 has a U-shaped loop 10, about ½ inch long by 3/16 inch wide. At the time of mounting filament 7, each loop 10 can be squeezed to draw up any slack on filament 7 between tubings 4 and 5.

The use of alumina tubing for bridge members 4 and 5, in accordance with one aspect of the invention, has contributed significantly to the strength of the mount structure. Alumina is hard and durable, and less expensive than quartz. It is relatively easy to fabricate into the desired shape and withstands shock and vibration testing of the lamp assembly. Further, the alumina bridge material does not interfere with the halogen cycle in the lamp.

Legs 12 of filament 7 extend from the upper ends of the outer coiled sections thereof, and are bent so that portions thereof abut and are parallel to rods 2 and 3, respectively, at a point about ½ inch below tubing bridge 4. Compressive coils 13, encircling legs 12 and the respective rods provide a secure electrical connection therebetween.

The sections of rods 2 and 3 that are in closest proximity to the outer coiled sections of filament 7 are bent at the center thereof to an angle of about 135°, the purpose being to increase the spacing therebetween and thus to reduce the cooling effect of the rods on the filament.

During assembly of the filament mount, coils 6 are first inserted on preshaped rods 2 and 3. The external ends of rods 2 and 3 are then clamped in a suitable holding device and coils 13 and 18 are inserted on the rods. Filament 7 is then assembled on tubings 4 and 5 by means of support wires 9 and tubings 4 and 5 are then mounted on rods 2 and 3. Rods 2 and 3 have sufficient flexibility to be spread apart enough for the mounting of bridge tubings 4 and 5 thereon. Legs 12 of filament 7 are then connected to their respective rods by means of coils 13. Filament 7 is then centrally positioned in the bridge and loops 10 of support wires 9 are squeezed, where necessary, to take up slack in filament 7. Tungsten rods 2 and 3 are then brazed to the molybdenum cups which had previously been sealed at 14 to the quartz base 15.

In accordance with the invention, the dome portion of quartz envelope 1 is provided with a pair of externally protruding cavities 22 and 23 which respectively receive and retain the ends of rods 2 and 3 so as to minimize wobble. Such a construction has been found to very substantially ruggedized the filament mount and overall lamp assembly so as to prevent breakage under conditions of shock and vibration.

Preferably, cavities 22 and 23 comprise tubular sections protruding from the exterior of the envelope and having one end open to the interior of the envelope and the other end closed by a seal. The internal diameter of each tubular section should be larger than the diameter of the rod retained, whereby the rods can be easily inserted during assembly, but not more than double the rod diameter, so as to avoid excessive wobble. The depth of each cavity should be at least about one-quarter inch to assure positive retention. In practice, the cavities 22 and 23 are provided by blowing two holes in the quartz dome, then sealing ½ inch sections of 3/16 inch I.D. quartz tubing to the exterior of the quartz envelope, about the holes, and tipping off the outer ends of the quartz tubing. Preferably, the wall thickness of the tubing should be at least about 1/16 inch to assure a strong, rugged rod-retainer.

In completing assembly, the filament mount is carefully inserted into envelope 1 so that rods 2 and 3 fit into cavities 22 and 23, and base 15 is sealed to the envelope.

Protruding arms of coils 6, 13 and 18 press slightly against the inside wall of envelope 1 to improve the support of the filament mount and to increase slightly the constriction of the coils.

Envelope 1 is then exhausted through the exhaust tube situated at the upper end thereof, filled with a gas mixture comprising an inert gas and a halogen, and sealed by constriction and tip off at 25. One example of a suitable full gas mixture comprises bromine and nitrogen at a pressure of 750 torr.

Although the invention has been described with respect to a specific embodiment, it will be appreciated that modifications and changes may be made by those skilled in the art without departing from the true spirit and scope of the invention.

What we claim is:

1. A tungsten-halogen lamp comprising:

an hermetically sealed, light-transmitting envelope of generally tubular shape having a base at one end and a generally dome-shaped portion at the other end;

a gas mixture within said envelope comprising an inert gas and a halogen;

a pair of tungsten lead-in rods extending through said base into the interior of said envelope, said rods having substantially parallel portions within said envelope;

a pair of bridge members within said envelope, each supported between said rods and disposed in a substantially parallel, spaced-apart relationship;

a tungsten filament having a plurality of coiled sections suspended between and supported by said bridge members; and a pair of externally protruding cavities provided in the dome portion of said envelope within which the ends of said rods are respectively retained but not sealed.

2. The lamp of claim 1 wherein said envelope is comprised of quartz.

3. The lamp of claim 2 wherein said bridge members are formed of alumina.

4. The lamp of claim 1 wherein each of said cavities comprises a tubular section protruding from the exterior of said envelope having one end open to the interior of said envelope and the other end closed by a seal, the internal diameter of each of said tubular sections being larger than the diameter of the rod retained therein but not more than double said rod diameter.

5. The lamp of claim 4 wherein said envelope is quartz and said cavities comprise sections of quartz tubing sealed to the exterior of said envelope.

6. The lamp of claim 4 wherein each of said cavities has a depth of at least about one-quarter inch.

7. The lamp of claim 5 wherein the wall thickness of the tubing forming each of said cavities is at least about 1/16 inch.

* * * * *